US007779910B2

(12) United States Patent
Watson

(10) Patent No.: US 7,779,910 B2
(45) Date of Patent: Aug. 24, 2010

(54) EXPANSION CONE FOR EXPANDABLE LINER HANGER

(75) Inventor: Brock Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 104 days.

(21) Appl. No.: 12/027,719

(22) Filed: Feb. 7, 2008

(65) Prior Publication Data

US 2009/0200041 A1 Aug. 13, 2009

(51) Int. Cl.
*E21B 23/03* (2006.01)

(52) U.S. Cl. ..... 166/208; 166/382; 166/384

(58) Field of Classification Search ..... 166/384, 166/207, 382, 206, 208
See application file for complete search history.

(56) References Cited

U.S. PATENT DOCUMENTS

| | | | | |
|---|---|---|---|---|
| 3,195,646 | A | 7/1965 | Brown | |
| 4,858,687 | A | 8/1989 | Watson et al. | |
| 5,095,980 | A | 3/1992 | Watson | |
| 5,127,472 | A | 7/1992 | Watson et al. | |
| 5,398,763 | A | 3/1995 | Watson et al. | |
| 5,522,458 | A | 6/1996 | Watson et al. | |
| 5,899,270 | A | 5/1999 | Watson | |
| 6,142,224 | A | 11/2000 | Stuebinger et al. | |
| 6,173,768 | B1 | 1/2001 | Watson | |
| 6,543,544 | B2 | 4/2003 | Schultz et al. | |
| 6,648,075 | B2 | 11/2003 | Badrak et al. | |
| 6,672,382 | B2 | 1/2004 | Schultz et al. | |
| 6,848,503 | B2 | 2/2005 | Schultz et al. | |
| 6,920,934 | B2 | 7/2005 | Badrak et al. | |
| 7,048,065 | B2 | 5/2006 | Badrak et al. | |
| 7,055,598 | B2 | 6/2006 | Ross et al. | |
| 7,114,559 | B2 * | 10/2006 | Sonnier et al. | 166/206 |
| 7,165,608 | B2 | 1/2007 | Schultz et al. | |
| 7,225,880 | B2 | 6/2007 | Braddick | |
| 7,243,731 | B2 | 7/2007 | Watson et al. | |

(Continued)

FOREIGN PATENT DOCUMENTS

| | | |
|---|---|---|
| EP | 1 717 411 | 11/2006 |

(Continued)

OTHER PUBLICATIONS

Notification Of Transmittal Of The International Search Report And The Written Opinion Of The International Searching Authority, or The Declaration (1 page); International Search Report (5 pages); Written Opinion Of The International Searching Authority (6 pages); all mailed on Jun. 22, 2009 in PCT International Application No. PCT/US2009/033411; (Total 12 pages).

(Continued)

*Primary Examiner*—Kenneth Thompson
(74) *Attorney, Agent, or Firm*—Joshua A. Griswold

(57) ABSTRACT

An expandable liner hanger system includes an expandable liner hanger and an expansion cone having a first outer diameter when driven through the expandable liner hanger in a first direction to expand the expandable tubing. The expandable liner hanger system also includes a polished bore receptacle having a lower end coupled to an upper end of the expandable liner hanger by a coupling, the coupling having an inner diameter smaller than the first outer diameter. In the run in condition, the expansion cone is positioned below the coupling.

20 Claims, 3 Drawing Sheets

U.S. PATENT DOCUMENTS

| | | | | |
|---|---|---|---|---|
| 7,278,492 | B2 | 10/2007 | Braddick | |
| 7,290,605 | B2 | 11/2007 | Waddell et al. | |
| 7,383,889 | B2 | 6/2008 | Ring et al. | |
| 7,513,313 | B2 | 4/2009 | Watson et al. | |
| 7,546,881 | B2 | 6/2009 | Lloyd et al. | |
| 7,559,365 | B2 | 7/2009 | Watson et al. | |
| 2002/0050354 | A1 | 5/2002 | Schultz et al. | |
| 2003/0019621 | A1 | 1/2003 | Schultz et al. | |
| 2003/0047320 | A1 | 3/2003 | Badrak et al. | |
| 2003/0131986 | A1 | 7/2003 | Schultz et al. | |
| 2004/0035578 | A1 | 2/2004 | Ross et al. | |
| 2004/0055759 | A1* | 3/2004 | Sivley, IV | 166/384 |
| 2004/0060706 | A1* | 4/2004 | Stephenson | 166/380 |
| 2004/0099423 | A1 | 5/2004 | Badrak et al. | |
| 2004/0168796 | A1* | 9/2004 | Baugh et al. | 166/207 |
| 2005/0015963 | A1 | 1/2005 | Costa et al. | |
| 2005/0028987 | A1 | 2/2005 | Watson et al. | |
| 2005/0039921 | A1 | 2/2005 | Schultz et al. | |
| 2005/0056433 | A1 | 3/2005 | Ring et al. | |
| 2005/0056434 | A1 | 3/2005 | Watson et al. | |
| 2005/0103502 | A1 | 5/2005 | Watson et al. | |
| 2005/0183863 | A1 | 8/2005 | Cook et al. | |
| 2005/0217866 | A1 | 10/2005 | Watson et al. | |
| 2005/0230123 | A1 | 10/2005 | Waddell et al. | |
| 2005/0236162 | A1 | 10/2005 | Badrak et al. | |
| 2005/0263292 | A1 | 12/2005 | Braddick | |
| 2005/0263294 | A1 | 12/2005 | Braddick | |
| 2006/0032640 | A1 | 2/2006 | Costa et al. | |
| 2006/0054330 | A1 | 3/2006 | Ring et al. | |
| 2006/0065403 | A1 | 3/2006 | Watson et al. | |
| 2006/0090902 | A1 | 5/2006 | Costa et al. | |
| 2006/0096762 | A1* | 5/2006 | Brisco | 166/384 |
| 2006/0137877 | A1 | 6/2006 | Watson et al. | |
| 2006/0157257 | A1 | 7/2006 | Ross et al. | |
| 2006/0162937 | A1* | 7/2006 | Costa et al. | 166/380 |
| 2006/0196679 | A1 | 9/2006 | Brisco et al. | |
| 2006/0207760 | A1 | 9/2006 | Watson et al. | |
| 2006/0225892 | A1 | 10/2006 | Watson et al. | |
| 2006/0243444 | A1 | 11/2006 | Brisco et al. | |
| 2006/0266527 | A1 | 11/2006 | Brisco et al. | |
| 2007/0110927 | A1* | 5/2007 | Head et al. | 428/34.1 |
| 2007/0144735 | A1 | 6/2007 | Lloyd et al. | |
| 2007/0227730 | A1 | 10/2007 | Brisco et al. | |
| 2008/0000645 | A1 | 1/2008 | Brisco et al. | |
| 2008/0035251 | A1 | 2/2008 | Brisco | |
| 2008/0066926 | A1 | 3/2008 | Costa et al. | |
| 2008/0142229 | A1 | 6/2008 | Brisco et al. | |
| 2008/0190616 | A1 | 8/2008 | Watson | |
| 2008/0236230 | A1 | 10/2008 | Brisco et al. | |
| 2008/0257542 | A1 | 10/2008 | Brisco et al. | |
| 2008/0257560 | A1 | 10/2008 | Brisco et al. | |
| 2009/0001721 | A1 | 1/2009 | Costa et al. | |
| 2009/0107686 | A1 | 4/2009 | Watson | |
| 2009/0193871 | A1 | 8/2009 | Brisco et al. | |

FOREIGN PATENT DOCUMENTS

| | | |
|---|---|---|
| GB | 2 402 952 | 12/2004 |
| GB | 2 412 394 | 9/2005 |
| WO | WO 2004/079157 | 9/2004 |

OTHER PUBLICATIONS

Versaflex® Liner Hanger System [online] Halliburton [retrieved on Oct. 10, 2007]. Available online at http://www.halliburton.com/ps/default.aspx?navid=110&pageid=642prodgrpid=MSE%3A%3AIQTWQICZF. (Total 1 page).

VersaFlex® Liner Systems, Simplifying Liner Installation With Reliable Expandable Solutions. Halliburton Product Brochure, 2007. Available online at http://www.halliburton.com/public/cps/contents/Brochures/web/H05234.pdf. (Total 4 pages).

Mota, Jose; Campo, Don; Nenezes, Joe; Jackson, Tance; Smith, Pete; "Drilling in with expandable liner hangers"; Expandables & Tubular Technology, Jun. 2006, (Total 2 pages).

* cited by examiner

EXPANSION CONE FOR EXPANDABLE LINER HANGER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to equipment and methods used in subterranean wells, and more particularly to an expansion cone for expanding an expandable liner hanger.

BACKGROUND OF THE INVENTION

In the process of drilling and completing oil wells, it has been common practice to place heavy steel casing in a well and to place cement between the casing and the well to anchor the casing in place and prevent migration of fluids outside the casing. After an upper portion of a well has been drilled and cased, it is common to continue drilling the well and to line a lower portion of the well with a liner lowered through the upper cased portion of the well. Liner hangers have been used to mechanically support the upper end of the liner from the lower end of the previously set casing and to seal the liner to the casing. Liner hangers have included slips for mechanical support and packers for forming a seal.

More recently, expandable liner hangers, such as those sold under the trademark VERSAFLEX by Halliburton Energy Services, have been developed. Expandable liner hangers provide both mechanical support and a fluid seal by use of a number of elastomeric rings carried on a section of expandable tubing. After the liner hanger is properly positioned in a cased portion of a well, an expansion cone may be forced through the liner hanger to expand the liner hanger expanding the elastomeric seals into contact with the casing to provide both mechanical support and a fluid seal.

SUMMARY OF THE INVENTION

An expandable liner hanger system includes an expandable liner hanger and an expansion cone having a first outer diameter when driven through the expandable liner hanger in a first direction to expand the expandable tubing. The expandable liner hanger system also includes a polished bore receptacle having a lower end coupled to an upper end of the expandable liner hanger by a coupling, the coupling having an inner diameter smaller than the first outer diameter. In the run in condition, the expansion cone is positioned below the coupling.

DETAILED DESCRIPTION OF THE PREFERRED EMBODIMENTS

In describing embodiments, a first element may be described as being above or up hole from a second element which is below or down hole from the first element. Some wells may include sections which are slanted or deviated from vertical and in some cases are horizontal. In such wells, the terms above or up hole mean located closer to the surface location of the well and the terms below or down hole mean closer to the end of the well most distant from the surface location of the well.

Figure 1:
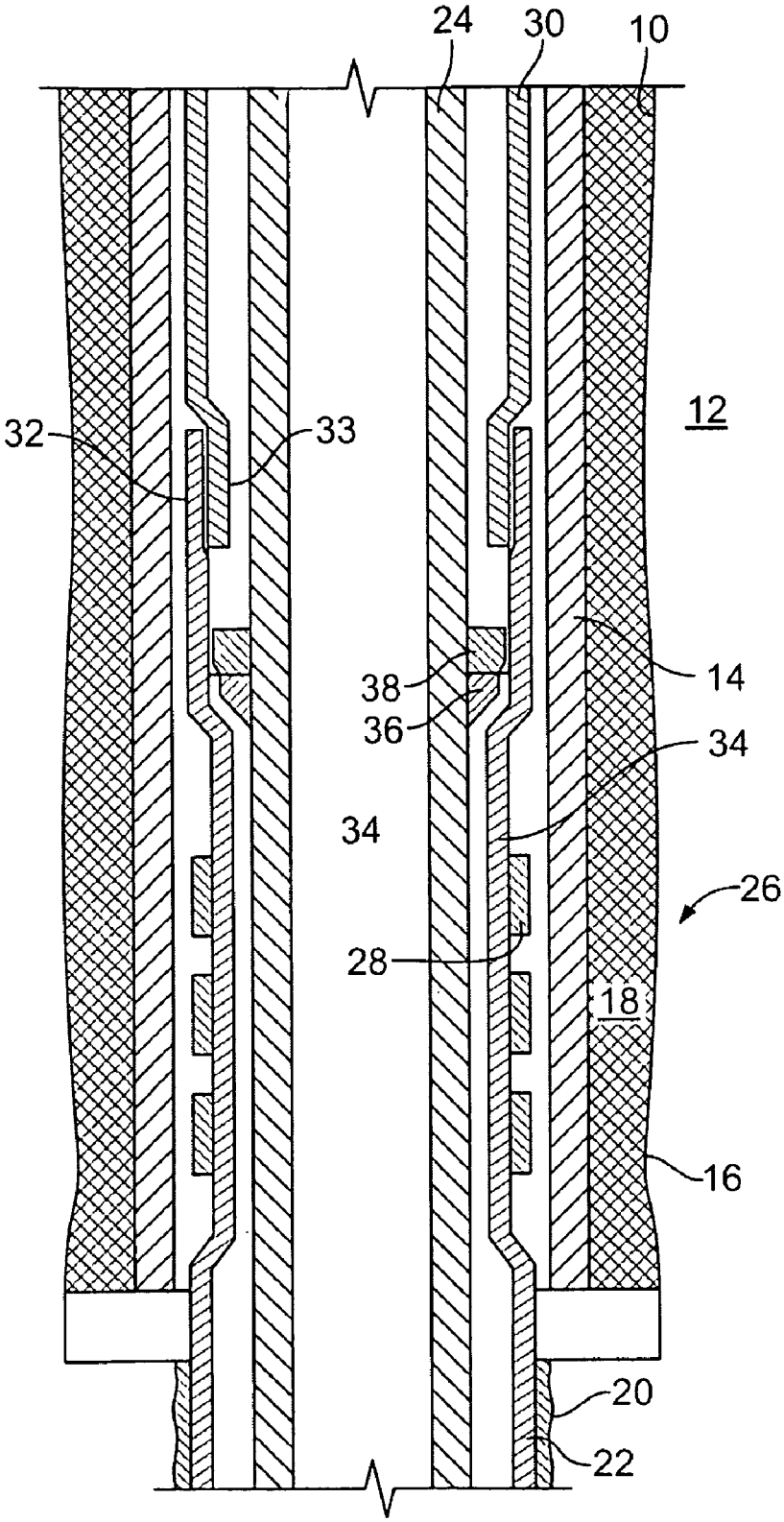
FIG. 1 is a schematic diagram of an expandable liner hanger system according to the disclosed embodiments.

FIG. 1 provides a somewhat schematic diagram of an expandable liner hanger system with an expansion cone according to embodiments of the present invention. FIG. 1 is not drawn to scale in order to more clearly illustrate the relative positions of various elements. A well 10 has been drilled through earth formation 12. A conventional steel casing 14 has been placed in an upper portion 16 of the well 10. Cement 18 has been placed between the casing 14 and the upper portion 16 of well 10.

Below casing 14, a lower section 20 of the well 10 has been drilled through casing 14 and therefore may have a smaller diameter than the upper portion 16. A length of liner 22 is shown positioned within the lower portion 20. The liner 22 may have been used to drill the lower portion 20, but in any case is used to line or case the lower portion 20. If desired, cement may be placed between the liner 22 and lower portion 20 of well 10. The liner 22 has been installed in the well 10 by means of a work string 24. The work string 24 may include a releasable collet, not shown, by which it can support and rotate the liner 22 as it is placed in the well 10.

Attached to the upper end of, or formed as an integral part of, liner 22 is a liner hanger 26 which includes a number of annular seals 28. While three seals 28 are illustrated, commercial expandable liner hangers may have five or more seals 28. Connected to the upper end of the liner hanger 26 is a polished bore receptacle, or tie back receptacle, 30. The polished bore receptacle 30 is connected to the liner hanger 26 by a coupling. In an embodiment, the polished bore receptacle 30 is connected to the liner hanger by a threaded joint 32, but in other embodiments a different coupling mechanism may be employed. As the name implies, the inner bore of the polished bore receptacle 30 is smooth and machined to close tolerance to permit work strings, production tubing, etc. to be connected to the liner 22 in a fluid and pressure tight manner. For instance, a work string may be connected by means of the polished bore receptacle 30 and used to pump fracturing fluid at high pressure down to the lower portion 20 of the well 10 without exposing the casing 14 to the fracturing pressure.

It is desirable that the outer diameter of liner 22 be as large as possible while being able to lower the liner 22 through the casing 14. It is also desirable that the outer diameter of the polished bore receptacle 30 and the liner hanger 26 be about the same as the diameter of liner 22. In the run in condition, the outer diameter of liner hanger 26 is defined by the outer diameter of the annular seals 28. In the run in condition, a body or mandrel 34 of liner hanger 26 has an outer diameter reduced by about the thickness of the seals 28 so that the outer diameter of the seals is about the same as the outer diameter of liner 22 and tie back receptacle 30.

In this embodiment, first and second expansion cones 36 and 38 are carried on the work string 24 just above the reduced diameter body 34 of the liner hanger 26. Fluid pressure applied between the work string 24 and the liner hanger 26 may be used to drive the cones 36, 38 downward through the liner hanger 26 to expand the body 34 to an outer diameter at which the seals 28 are forced into sealing and supporting contact with the casing 14. The first expansion cone 36 is a solid, or fixed diameter, cone having a fixed outer diameter smaller than the inner diameter 33 of the threaded joint 32. In the run in condition, second expansion cone 38 has an outer diameter greater than first cone 36 and also greater than the inner diameter 33 of the threaded joint 32. In an embodiment, the second expansion cone 38 is collapsible, that is, may be reduced in diameter smaller than the inner diameter 33 of the threaded joint 32 when it needs to be withdrawn from the liner hanger 26. In some contexts, the second expansion cone 38 may be referred to as a collapsible expansion cone. As in prior art systems, after the liner hanger 26 is expanded, expansion cones 36, 38 are withdrawn from the liner hanger 26, through the polished bore receptacle 30 and out of the well 10 with the work string 24.

The threaded joint 32 must be able to withstand the working pressure inside liner 22, for example, the pressure of a fracturing operation. In prior art systems, a single solid expansion cone, like first expansion cone 36 has been used to expand expandable liner hangers. The single expansion cone had a diameter equivalent to cone 38. In order to withdraw such a fixed cone from the well, the inner diameter 33 of the threaded joint 32 needed to be essentially the same as the inner diameter of the polished bore receptacle 30. The wall thicknesses of the threaded portions of the upper end of liner hanger 26 and the lower end of the polished bore receptacle 30 were each reduced by about half so that the assembly did not have increased outer diameter or decreased inner diameter at the joint 32. The joint therefore limited the burst, collapse and tensile ratings of the system, resulting in pressure ratings of about four to eight thousand pounds per square inch.

In the embodiment of FIG. 1, the coupling portions of both the upper end of liner hanger 26 and the lower end of the polished bore receptacle 30 have increased wall thickness, relative to the prior art, to provide increased burst, collapse and tensile ratings, allowing the system to be used in wells where increased pressures are needed for various well treatments. The coupling portions may have about the same wall thickness as the liner hanger 26 and the polished bore receptacle 30. The thicker coupling portions may provide a pressure rating of about eight to twelve thousand pounds per square inch. Since the outer diameter of the system is limited by the inner diameter of casing 14, the extra wall thickness of the high strength joint 32 is placed on the inner surface resulting in a reduced inner diameter 33 at the joint 32. The reduced inner diameter 33 would prevent prior art fixed diameter expansion cones from being withdrawn from the liner hanger 26. The collapsible cone system disclosed herein allows full expansion of the liner hanger 26, while still permitting the expansion cone assembly to be withdrawn through the joint 32. In an embodiment, the coupling portions may be provided by threaded portions of the upper end of liner hanger 26 and the lower end of the polished bore receptacle 30. For example, in an embodiment, the coupling portion of the upper end of the expandable liner hanger 26 is a threaded coupling portion and the coupling portion of the lower end of the polished bore receptacle 30 is a threaded coupling portion. In an embodiment, the lower end of the polished bore receptacle 30 is threaded inside the upper end of the expandable liner hanger 26.

Figure 2:
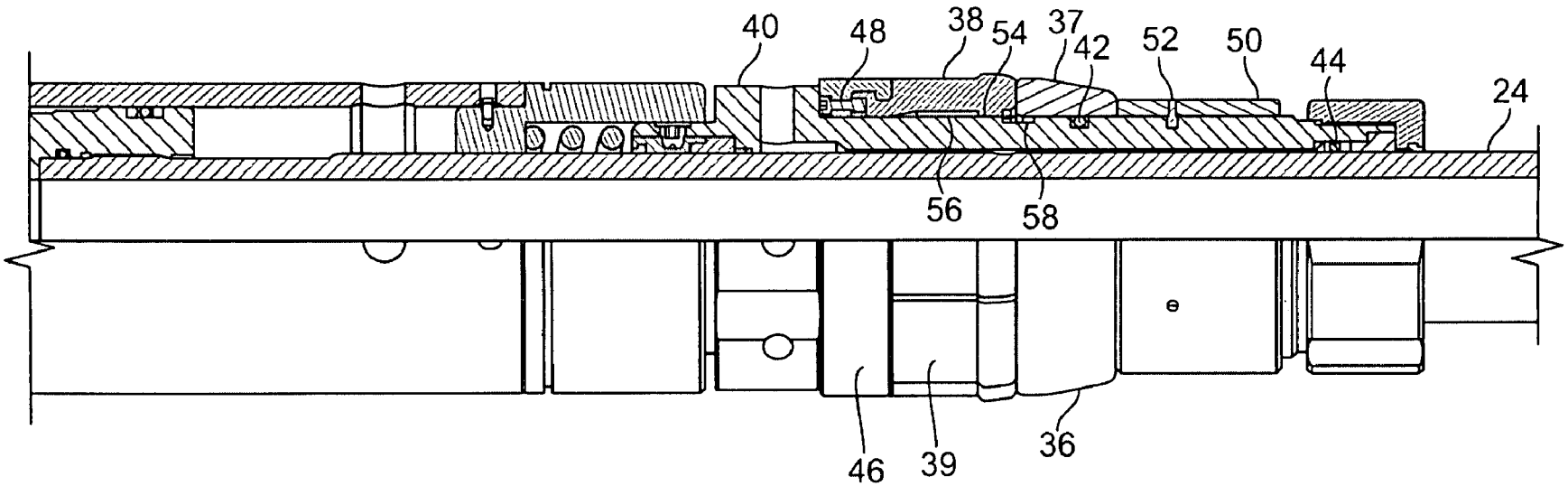
FIG. 2 is a quarter section drawing of a collapsible expansion cone for an expandable liner hanger system according to an embodiment in a run in condition.

With reference to FIG. 2, an embodiment of a collapsible expansion cone assembly for an expandable liner hanger system will be described. Elements which correspond to elements shown in FIG. 1 are identified by the same reference numbers. The first, or solid, expansion cone 36 is carried on a cone mandrel 40, which is carried on the work string 24. A seal 42, e.g. an O-ring, provides a fluid seal between the inner diameter of cone 36 and the outer diameter of mandrel 40. A seal 44, e.g. an O-ring, provides a fluid seal between the inner diameter of mandrel 40 and the outer diameter of work string 24. During expansion of the liner hanger 26, an outer surface 37 of the cone 36 forms a fluid tight seal with the inner surface of the liner hanger 26. Fluid pressure between work string 24 and the liner hanger 26 may be applied to the expansion cones 36, 38 and cone mandrel 40 to drive the cones down through the liner hanger 26 and expand the liner hanger 26 into sealing and supporting engagement with the casing 14. As known in the prior art, the pressure may be applied through force multipliers to the mandrel 40 and the expansion cones 36, 38.

In an embodiment, the second expansion cone 38 is formed of a plurality of cone segments 39, for example eight, as shown in FIG. 2. A retainer ring 46 is carried on the cone mandrel 40 and retains each of the segments 39 on the cone mandrel 40, while allowing the segments to move radially to some extent as shown below. A plurality of screws or pins 48, one for each cone segment 39, may be used to maintain the circumferential distribution of the segments around the cone mandrel 40.

A shear pin ring 50 is carried on the cone mandrel 40 below and adjacent the solid cone 36. In the run in condition, the ring 50 is prevented from sliding relative to the mandrel 40 by one or more shear pins 52. The ring 50 in turn prevents the cones 36 and 38 from sliding downward on the mandrel 40.

Figure 3:
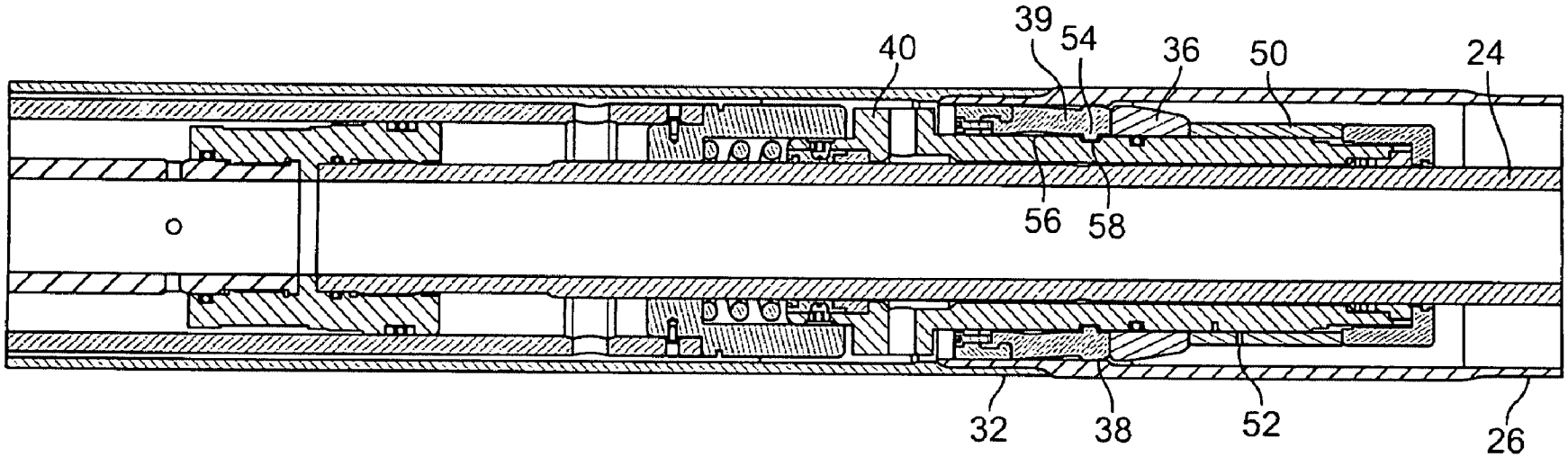
FIG. 3 is a cross section drawing of the expansion cone of FIG. 2 in a collapsed condition for removal from the well after expansion of an expandable liner hanger.

With reference to FIG. 3, the collapsed, or reduced diameter, condition of the expansion cone assembly is illustrated. Each segment 39 of the second expansion cone 38 includes a lug 54 on it inner surface, i.e. the surface facing the cone mandrel 40. In FIG. 2, the lugs 54 are positioned on a primary outer surface 56 of the mandrel 40, which holds the cone segments 39 in their outermost position. After expansion of the liner hanger 26, the work string 24 is pulled or lifted out of the liner hanger 26. When the second expansion cone 38 reaches the threaded joint 32, it will be too large to pass through the joint 32. As the work string 24 is lifted, the force on the second expansion cone 38 will be transferred to the shear pin 52 until the pin is sheared. When pin 52 shears, the mandrel 40 is permitted to move upward relative to the shear pin ring 50, the first expansion cone 36 and second expansion cone 38. When mandrel 40 moves upward a short distance, a recess ring 58 in the cone mandrel 40 moves under the lugs 54. The lugs 54 then move down into the recess ring 58 as shown in FIG. 3. The outer diameter of the second expansion cone 38 is thereby reduced to about the same diameter as the first expansion cone 36 and is small enough to pass through the joint 32 without interference.

In operation, the expandable liner hanger 26 is assembled on work string 24 with the liner 22, expansion cones 36, 38 and the polished bore receptacle 30 as shown in FIGS. 1 and 2. Since the inner diameter 33 of joint 32 is defined by the lower portion of polished bore receptacle 30 and is smaller than the second expansion cone 38, the polished bore receptacle 30 may be assembled after the expansion cones 36, 38 have been assembled in the upper end of liner hanger 26. Other elements, such as a drill bit on the lower end of liner 22, may be included in the complete assembly if desired. The entire assembly is then run in to a well which has been previously drilled, cased with conventional casing, and cemented. If desired, the lower portion 22 of the well 10 may be drilled using a bit carried on the liner 22. The liner may then be cemented into the lower portion 22 of the well 10. When it is desired to set the liner hanger 26 in casing 14, fluid pressure may be supplied through the work string 24 to the expansion cones 36, 38. Various force multipliers, which are well known in the prior art, may be used to provide force sufficient to drive the expansion cones 36, 38 through the liner hanger 26. The expansion cones 36, 38 are driven down through the liner hanger 26, expanding its body 34 and driving the seals 28 into firm contact with the casing 14. When the liner hanger 26 is fully expanded, the work string may be lifted from the well leaving the expanded liner hanger installed in the well. When the second expansion cone 38 contacts the joint 32, it will resist further upward movement of the work string 24 until sufficient force is applied to shear the shear pin 52. The cone mandrel 40 will then move upward relative to the expansion cones 36, 38 until the second expansion cone 38 lugs 54 fall into the recess ring 58. The expansion cones 36, 38 will then continue moving upward with the work string 24 and may be removed from the well 10

In designing the collapsible expansion cone system of the present embodiment, it became apparent that the system may provide advantages in prior art liner hanger systems which do not have the high strength joint 32 shown in FIG. 1. When the expansion cones 36, 38 reach the bottom of liner hanger 26, they have compressed the seals 28 between the expanded body 34 of liner hanger 26 and the casing 14. The seals 28 are preferably elastomeric, e.g. rubber, and retain very high compression forces. These forces and elastic forces in the liner hanger body 34 and casing 14 typically cause the inner diameter of the body 34 to rebound to an inner diameter somewhat smaller than the maximum outer diameter of the second expansion cone 38 at the locations of the seals 28. As the work string 24 is lifted for removal from well 10, the expansion cones 36, 38 must pass back through the liner hanger 26 and cone 38 may encounter significant friction forces at the locations of the seals 28. These forces may cause damage to the work string 24. If these forces exceed the force needed to shear the shear pin 52, the second expansion cone 38 will collapse as described above. Once the second expansion cone 38 collapses, the assembly will easily pass through the expanded liner hanger 26 and the threaded joint 32 with minimal resistance. Thus while the disclosed collapsible cone assembly was designed to work with high strength threaded joints, it has also solved a problem encountered in liner hanger systems with conventional threaded joints, or with no threaded joints at all, for example systems without a polished bore receptacle.

Thus, an expandable liner hanger system in one embodiment includes an expandable liner hanger assembled with a collapsible cone having a first diameter when driven through the expandable liner hanger in a first direction to expand the expandable liner hanger and having a second smaller diameter in response to movement of the collapsible cone in a second direction, e.g. when being removed from the well. The expandable liner hanger and the collapsible cone are manufactured as separate parts, but the expansion cone is preferably installed in the upper end of the liner hanger to form a system for running into a well and expansion of the liner hanger at a selected location in a well. Assembly may occur in a factory location, at a well head, or other location. After expansion of the liner hanger, the collapsible expansion cone is removed from the liner hanger and the well, leaving the liner hanger installed in the well.

In an embodiment, the system includes a work string on which both the collapsible cone and the expandable liner hanger are assembled to facilitate running into a well and operation of the expansion cone for expanding the liner hanger. The work string also facilitates collapse of the collapsible cone, separation of the expansion cone from the liner hanger, and removal of the expansion cone from the well.

A system may also include a polished bore receptacle connected to the upper end of the expandable liner hanger with a threaded joint, which may be a high strength joint, above the collapsible cone for running into the well on a work string. A system preferably includes a solid cone installed in the upper end of the expandable liner hanger below the collapsible cone for running into the well on a work string.

While the present invention has been illustrated and described with reference to specific embodiments, it is apparent that various modifications and substitutions of equivalent parts may be made within the scope of the invention as described by the appended claims.

I claim:

1. An expandable liner hanger system, comprising:

an expandable liner hanger;

a first expansion cone having a first outer diameter when driven through the expandable liner hanger in a first direction to expand the expandable liner hanger; and a polished bore receptacle having a lower end coupled to an upper end of the expandable liner hanger by a coupling, the coupling having an inner diameter smaller than the first outer diameter, wherein in a condition in which the expandable liner hanger is run into a well the first expansion cone is positioned below the coupling.

2. An expandable liner hanger system, comprising:

an expandable liner hanger;

a first expansion cone having a first outer diameter when driven through the expandable liner hanger in a first direction to expand the expandable liner hanger;

a polished bore receptacle having a lower end coupled to an upper end of the expandable liner hanger by a coupling, the coupling having an inner diameter smaller than the first outer diameter, wherein in a condition in which the expandable liner hanger is run into a well the first expansion cone is positioned below the coupling, wherein the first expansion cone is a collapsible expansion cone, wherein the collapsible expansion cone is adapted to have a second outer diameter smaller than the first outer diameter in response to movement of the collapsible expansion cone in a second direction through the expandable liner hanger, and wherein the inner diameter of the coupling is larger than the second outer diameter; and a work string positioned within the expandable liner hanger, wherein the collapsible expansion cone is carried on the work string.

3. The system of claim 2, further comprising:

a cone mandrel carried on the work string, wherein the collapsible expansion cone is carried on the cone mandrel, and is axially slidable on the cone mandrel from a first position to a second position.

4. The system of claim 3, wherein:

the collapsible expansion cone comprises a plurality of cone segments, each segment having a first side adjacent the cone mandrel and a second side opposite the first side, the second side defining the collapsible expansion cone outer diameter, the cone mandrel has a first diameter over a first portion of its length and a second diameter, smaller than the first diameter, over a second portion of its length, and the cone segments are supported by the first diameter portion of the cone mandrel when the collapsible expansion cone is in its first position and supported by the second diameter portion of the cone mandrel when the collapsible expansion cone is in its second position.

5. The system of claim 3, wherein:

the collapsible expansion cone has the first outer diameter when in the first position and has the second outer diameter when in the second position.

6. The system of claim 3, wherein:

the collapsible expansion cone moves from the first position to the second position in response to movement of the cone mandrel in the second direction.

7. The system of claim 2, wherein the coupling is a threaded joint, further comprising:

a second expansion cone positioned below the collapsible expansion cone and having a fixed diameter smaller than the threaded joint inner diameter.

8. The system of claim 1, wherein:

the coupling is a threaded joint and the lower end of the polished bore receptacle has about the same wall thickness as an unthreaded upper portion of the polished bore receptacle and wherein the upper end of the expandable liner hanger has about the same wall thickness as an unthreaded lower portion of the expandable liner hanger.

9. The system of claim 8, wherein:

the threaded joint provides a pressure rating of about eight thousand to twelve thousand pounds per square inch.

10. The system of claim 1, wherein:

the coupling is a threaded joint and the polished bore receptacle lower end is threaded inside the upper end of the expandable liner hanger.

11. The system of claim 1, wherein the expandable liner hanger comprises:

a section of expandable tubing, and one or more seal rings carried on the expandable tubing, the expandable tubing and seal rings selected to form a seal with an interior surface of a well casing when the expandable tubing is expanded.

12. The system of claim 1, further comprising:

a length of liner having an upper end connected to a lower end of the expandable liner hanger.

13. A method of installing a liner hanger in a casing in a well, comprising:

assembling on a work string an expandable liner hanger, a polished bore receptacle, and a first expansion cone, a lower end of the polished bore receptacle coupled to the upper end of the expandable liner hanger by a coupling, the first expansion cone having a first diameter as assembled and assembled below the coupling;

running the work string into the well and positioning the liner hanger within the casing; and forcing the first expansion cone through the expandable liner hanger and thereby expanding the liner hanger into operative contact with the casing, wherein the first diameter is greater than an inner diameter of the coupling.

14. A method of installing a liner hanger in a casing in a well, comprising:

forming a threaded coupling on an upper end of an expandable liner hanger;

forming a threaded coupling on a lower end of a polished bore receptacle;

threading the threaded coupling on the upper end of the expandable liner hanger to the threaded coupling on the lower end of the polished bore receptacle, thereby forming a coupling, the coupling having an inner diameter smaller than a collapsible expansion cone first diameter and greater than a collapsible expansion cone second diameter;

assembling on a work string the expandable liner hanger, the polished bore receptacle, and a first expansion cone, the lower end of the polished bore receptacle coupled to the upper end of the expandable liner hanger by the coupling, the first expansion cone having the first diameter as assembled and assembled below the coupling, running the work string into the well and positioning the liner hanger within the casing;

forcing the first expansion cone through the expandable liner hanger and thereby expanding the liner hanger into operative contact with the casing;

wherein the first diameter is greater than an inner diameter of the coupling, reducing the diameter of the collapsible expansion cone to the second diameter; and lifting the work string and collapsible expansion cone from the expandable liner hanger.

15. The method of claim 14, further comprising:

assembling on the work string a second expansion cone, the second expansion cone having a fixed outer diameter smaller than the coupling inner diameter, and forcing the second expansion cone through the expandable liner hanger ahead of the collapsible expansion cone.

16. The method of claim 13, further comprising:

applying fluid pressure through the work string to the first expansion cone and thereby forcing the first expansion cone through the expandable liner hanger.

17. The method of claim 13, wherein the first expansion cone is a collapsible expansion cone having a second diameter smaller than the first diameter when collapsed and further comprising:

reducing the diameter of the collapsible expansion cone to the second diameter; and lifting the work string and collapsible expansion cone from the expandable liner hanger, wherein the reducing occurs as a result of lifting the work string and the collapsible expansion cone from the expandable liner hanger.

18. The method of claim 13, wherein the first expansion cone is a collapsible expansion cone having a second diameter smaller than the first diameter when collapsed and further comprising:

assembling the collapsible expansion cone on a cone mandrel carried on the work string;

positioning the collapsible expansion cone at a first axial location on the cone mandrel at which the collapsible expansion cone has the first diameter, and positioning the collapsible expansion cone at a second axial location on the cone mandrel at which the collapsible expansion cone has the second diameter.

19. The method of claim 13, further comprising:

attaching a length of liner to a lower end of the expandable liner hanger; and running the liner into the well with the work string.

20. The method of claim 13, wherein the first expansion cone is a collapsible expansion cone having a second diameter smaller than the first diameter when collapsed and further comprising:

reducing the diameter of the collapsible expansion cone to the second diameter; and lifting the work string and collapsible expansion cone from the expandable liner hanger.

* * * * *